US009106999B2

(12) United States Patent
Darlington

(10) Patent No.: US 9,106,999 B2
(45) Date of Patent: Aug. 11, 2015

(54) NOISE REDUCING EARPHONE

(75) Inventor: Paul Darlington, Bussigny-Pres-Lausanne (CH)

(73) Assignee: Soundchip SA, Bussigny-Pres-Lausanne (CH)

( * ) Notice: Subject to any disclaimer, the term of this patent is extended or adjusted under 35 U.S.C. 154(b) by 127 days.

(21) Appl. No.: 13/997,033

(22) PCT Filed: Dec. 23, 2011

(86) PCT No.: PCT/GB2011/001767

§ 371 (c)(1), (2), (4) Date: Aug. 7, 2013

(87) PCT Pub. No.: WO2012/085514

PCT Pub. Date: Jun. 28, 2012

(65) Prior Publication Data

US 2013/0336513 A1 Dec. 19, 2013

(30) Foreign Application Priority Data

Dec. 23, 2010 (GB) ..... 1021912.9

(51) Int. Cl.

*H04R 1/10* (2006.01)
*H04R 1/28* (2006.01)
*H04R 3/02* (2006.01)

(52) U.S. Cl.

CPC ..... *H04R 1/1075* (2013.01); *H04R 1/1083* (2013.01); *H04R 1/2884* (2013.01); *H04R 3/02* (2013.01); *H04R 1/1016* (2013.01); *H04R 1/2888* (2013.01); *H04R 2460/01* (2013.01)

(58) Field of Classification Search

CPC ..... H04R 1/222; H04R 1/28; H04R 1/2803; H04R 1/2807; H04R 1/1075; H04R 1/2884

USPC ..... 181/130, 135, 196; 381/380, 162, 337, 381/338, 353, 417, 418, 328, 56, 58, 94.9

See application file for complete search history.

(56) References Cited

U.S. PATENT DOCUMENTS 5,208,868 A * 5/1993 Sapiejewski ..... 381/338
5,692,059 A 11/1997 Kruger (Continued)

FOREIGN PATENT DOCUMENTS

| | | |
|---|---|---|
| EP | 0440572 | 8/1991 |
| EP | 2280557 | 2/2011 |
| KR | 20080072323 | 8/2008 |

OTHER PUBLICATIONS

European Search and Examination Report in European Patent Application No. GB1021912.9, May 26, 2011.

(Continued)

*Primary Examiner* — Jesse Elbin

(74) *Attorney, Agent, or Firm* — Lempia Summerfield Katz LLC

(57) ABSTRACT

Earphone apparatus (10) comprising: a body (20) configured to be inserted at least in part into an auditory canal of a user's ear, the body (20) housing a driver (30) and defining a passageway (40) connecting the driver (30) to an opening (50) in the body (20) for allowing sound generated by the driver (30) to pass into the auditory canal of the user's ear; and a sensing microphone (60) coupled to the body (20) for providing a feedback signal to a signal processor, the sensing microphone (60) comprising a sensing element (62)(62')(62") positioned to sense sound present in the auditory canal of the user's ear; wherein the sensing element (62) (62')(62") is spaced from the driver (30).

9 Claims, 9 Drawing Sheets

(56) References Cited

U.S. PATENT DOCUMENTS

| | | | | |
|---|---|---|---|---|
| 5,852,667 | A * | 12/1998 | Pan et al. | 381/71.1 |
| 6,661,901 | B1 | 12/2003 | Svean et al. | |
| 6,754,359 | B1 | 6/2004 | Svean et al. | |
| 8,472,637 | B2 * | 6/2013 | Carreras et al. | 381/71.6 |
| 2008/0144842 | A1 | 6/2008 | Goldstein et al. | |
| 2010/0278355 | A1 * | 11/2010 | Yamkovoy | 381/94.9 |
| 2011/0058702 | A1 * | 3/2011 | Saggio, Jr. | 381/380 |
| 2011/0064238 | A1 * | 3/2011 | Haas | 381/71.6 |

OTHER PUBLICATIONS

International Search Report and Written Opinion in International Patent Application No. PCT/GB2011/001767, dated Nov. 16, 2012, 10 pages.

* cited by examiner

NOISE REDUCING EARPHONE

RELATED APPLICATION DATA

This U.S. national phase application is based on international application no. PCT/GB2011/001767, filed on Dec. 23, 2011, which claimed priority to British national patent application no. 1021912.9, filed on Dec. 23, 2010. Priority benefit of these earlier filed applications is hereby claimed.

The present invention relates to noise reducing earphones and particularly, but not exclusively, to noise reducing earphones comprising a Balanced Armature (BA) driver.

Embodiments of headphones equipped with active noise reducing functionality are familiar commercial offerings. There are also commercial precedents for earphones (i.e. in-ear or "in-the-canal" devices alternatively referred to as earpieces or in-ear-headphones/monitors) with similar active noise reducing functionality. In the context of the earphone, the active control system is useful not only in reducing ambient noise transmitted through and around the earpiece to the middle ear but also in reducing the "occlusion effect" in which normally unnoticeable internally generated sounds in a user's body reverberate off the earphone resulting in undesirable echo-like sounds being perceived by the user when using the earphones. Whilst the majority of these prior art earphones are based upon transducer means including "dynamic" drivers (miniature loudspeakers) and Electret Condenser Microphones (ECMs), there is a desire to provide active noise reducing earphones incorporating BA drivers.

The application of BA drivers in active noise reducing earphones is motivated by two factors: size and audio quality. Although a very old electro-acoustic technology, the current generation of BA devices was developed for specialist application in hearing aids. The miniaturisation of hearing aids has driven attendant miniaturisation of BA drivers, which now are available in sizes suitable for in-ear or "in-the-canal" devices. The high audio quality of these devices has been recognized by manufacturers of professional earphone systems and now provides a strong driver for application of BA drivers in high performance consumer audio products. The combination of the attractively small size, high audio quality and market pull motivates the integration of BA technologies in consumer earphones with active noise reduction functionality.

Unfortunately, fundamental electro-acoustic differences between the conventional "dynamic" transducers and the BA devices make widely understood, prior art methods for design, controller architecture and system integration of active noise reducing earphones inappropriate. The present applicant has identified the need for an improved technique for incorporating a BA driver in an earphone system capable of supporting active noise reduction and occlusion management that seeks to address, or at least alleviate, problems associated with prior art techniques developed based on conventional "dynamic" transducer technology.

In accordance with the present invention, there is provided earphone apparatus comprising: a body configured to be inserted at least in part into an auditory canal of a user's ear, the body housing a driver and defining a passageway connecting the driver to an opening in the body (e.g. a passageway extending from the driver to an opening in an outer surface of the body defined by a grommet (or tip) part of the body) for allowing sound generated by the driver to pass into the auditory canal of the user's ear; and a sensing microphone coupled to the body for providing a feedback signal to a signal processor, the sensing microphone comprising a sensing element positioned to sense sound present in the auditory canal of the user's ear.

In one embodiment the driver is a Balanced Armature (hereinafter "BA") driver or other high source impedance driver (e.g. a driver having an acoustic source impedance that is higher than the acoustic input impedance of the human ear over substantially the entire human hearing range of frequencies (e.g. over the range 20 Hz-20 kHz)).

In one embodiment, the sensing element is spaced from the driver (e.g. along the passageway). In this way, an improved earphone apparatus is provided of the type in which a feedback signal (based on sound sensed by the sensing element) is supplied to a signal processor configured to generate a noise suppression signal capable of removing or reducing occlusion effects from the sound heard by the user. The present applicant has identified that the apparently counter-intuitive step of positioning the sensing element of an active occlusion management system away from the driver advantageously reduces resonance effects generated by the passageway (or "waveguide") to an extent that outweighs the inherent phase delay resulting from such positioning. This improvement has been found to be particularly advantageous in applications where the driver is a BA driver or similar high source impedance driver (e.g. of the type comprising a spout or nozzle for transmitting sound to the user's ear) where resonance effects generated by the passageway may be more pronounced than with a conventional low source impedance dynamic driver. By reducing resonance effects generated by the passageway, the sensing microphone can provide a feedback signal which reduces subsequent filtering performed by the signal processor (or Active Noise Reduction (ANR) processor) to allow for improved removal of occlusion noise. The signal processor may form part of the earphone apparatus and may be located inside or outside of the body.

In one embodiment, the sensing element is positioned along the passageway. The present applicant has identified that increased spacing along the passageway surprisingly reduces the degree of resonance generated by the location of the sensing element in the passageway. In one embodiment, the sensing element is located more than halfway along the length of the passageway (e.g. closer to the opening than to the driver). For example, the sensing element may be located more than two-thirds of the way along the length of the passageway.

In one embodiment, the sensing element is positioned adjacent (e.g. substantially at) the opening in the body.

In one embodiment, the earphone apparatus may further comprise an electronic filter (e.g. active noise control circuitry) configured to compensate for resonance effects generated by the location of the sensing element (e.g. location of the sensing element at the driver or spaced from the driver). In this way, undesirable resonance effects may be reduced (or further reduced in the case of a sensing element spaced from the driver) to improve performance of the feedback control. In one embodiment, the electronic filter comprises a notch filter (e.g. with a peak filter response tuned to compensate for the resonance effect provided by the passageway).

In another embodiment, the sensing element is positioned outside of the passageway (e.g. in a location beyond the opening in the body with the sensing element being acoustically linked to the driver by an acoustic path (e.g. open acoustic path) extending through the full length of the passageway). In one embodiment, the passageway has a mean cross-sectional dimension (e.g. cross-sectional diameter in the case of a cylindrical passageway or mean cross-sectional diameter in the case of a frusto-conical passageway) and the sensing element is spaced from the opening by a distance equal to at least half the mean cross-sectional dimension. In one embodiment the sensing element is located in a more advanced position than the opening when the body is inserted at least in part into the auditory canal of a user's ear (e.g. with the opening trailing the sensing element during insertion of the body). For example, the sensing element may be provided on a protuberant part of the earphone apparatus that extends into the auditory canal of the user's ear beyond the position of the opening.

In another embodiment, the body defines a further passageway extending to a further opening in the body (in the outer surface of the body), and the sensing element is located within the further passageway. Advantageously, the positioning of the sensing element in the further passageway has been found to have negligible impact on the open loop response of the system. Furthermore, the provision of a further passageway has been found to facilitate integration of microphone types whose geometries otherwise would be difficult to accommodate in an earpiece such as MicroElectrical-Mechanical system (MEMs) microphones (or "silicon microphones").

The first-defined opening may be located on a leading end of the body (e.g. facing the auditory canal of the user's ear). The further opening may also be located on a leading end of the body (e.g. adjacent the first-defining opening). The further passageway may be substantially parallel to the first-defined passageway.

In one embodiment, the further passageway comprises a microphone cavity housing the sensing element and a neck region acoustically connecting the microphone cavity to the further opening, the microphone chamber having a mean cross-sectional dimension which is larger than a mean cross-sectional dimension of the neck region (e.g. with the diameter of the neck region being no greater than ⅕ the characteristic dimension of the microphone cavity). In this way, a (sealed) volume of air may be provided in front of the sensing element to advantageously provide an acoustic low-pass filtering action to reduce the effect of high frequency driver resonance on the sensing microphone. This acoustic low-pass filtering action may be particularly important in the case of a high source impedance driver (e.g. BA driver) which will typically exhibit significant high frequency resonance). It will be noted that the low-pass filtering of the driver signal is achieved by the connection of the first-defined and further passageways when the body is inserted at least in part into the auditory canal of the user's ear rather than an acoustic connection formed inside the body.

The microphone chamber may be substantially spherical or substantially cubic.

In one embodiment, the neck region is configured to express principally resistive impedance (e.g. to provide an acoustic low-pass filtering action of first differential order). In another embodiment, the neck region is configured to further express inductive impedance (e.g. to provide an acoustic low-pass filter benefiting from the higher roll-off rates possible with second differential order).

In another embodiment, the earphone apparatus further comprises an electronic low-pass filter. Advantageously, the use of an electronic low-pass filter may avoid or alleviate certain limitations of an acoustic low-pass filter. In one embodiment, the electronic low-pass filter configured to minimise (or at least reduce) passband phase disturbance introduced by the lowpass filtering. For example, the electronic low-pass filter may be provided with underdamped tuning. In one embodiment, the earphone apparatus further comprises a notch filter. The notch filter may be configured to compensate for discrete peaks in the plant response (e.g. typically seen in the 2-3 kHz region for a BA driver due to fundamental mechanical resonances of the driver). Advantageously, the provision of both an electronic low-pass filter and a notch filter allows a corner frequency of the low-pass filter to be set at a higher frequency, thereby minimising phase effects at low frequency.

In the embodiments defined above, the body may be configured to substantially acoustically seal the auditory canal of the user's ear when inserted into the user's ear (e.g. to improve low frequency response of the system, particularly in a BA driver system).

The earphone apparatus of the present invention may be used in any application in which personal listening is required.

In one embodiment, the earphone apparatus forms part of a hearing-aid.

In another embodiment, the earphone apparatus forms part of a headset including a microphone for a user to speak into (e.g. for use with a mobile telephone).

Embodiments of the present invention will now be described by way of example with reference to the accompanying drawings in which.

BACKGROUND: BA DRIVERS

VA drivers have been developed in the art for applications in which the acoustic output is conducted from an output "spout" on the device to the ear through a network of small pipes (sometimes called "waveguides"). This is in significant contrast to the dynamic driver, in which the acoustic output is developed over the surface area of a relatively large "diaphragm".

Figure 1:
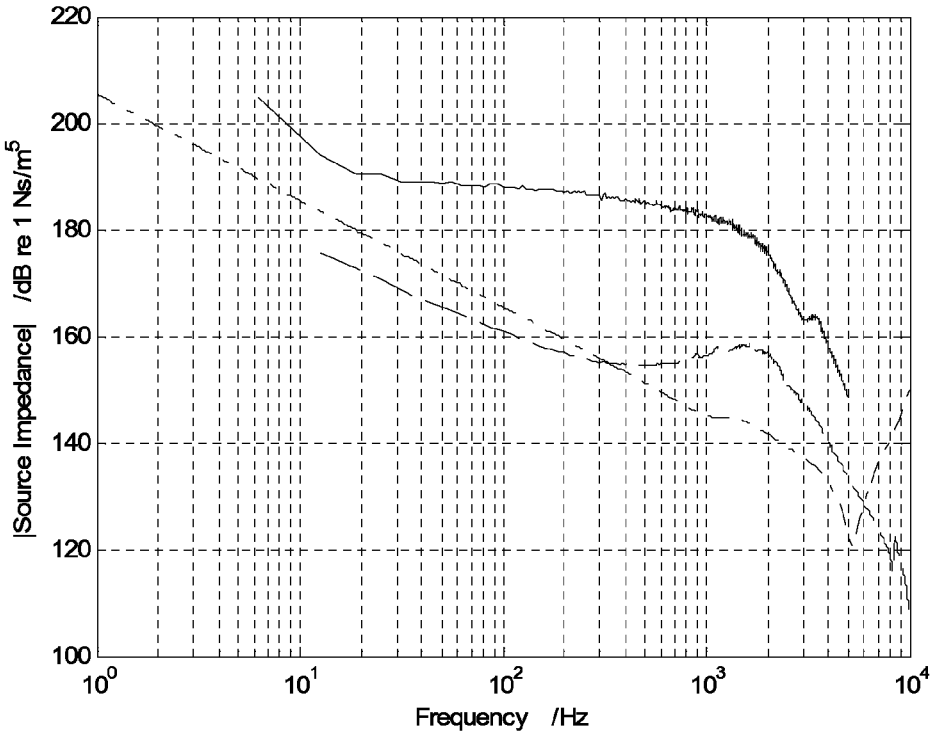
FIG. 1 is a graph showing a comparison of acoustic source impedances of a BA driver and a dynamic driver.

This distinction is a symptom of and reinforced by differences in the acoustic source impedances of the two technologies. The source impedance of a typical BA driver is contrasted with that of a small dynamic driver in FIG. 1 showing experimentally derived estimates of the acoustic source impedances of a BA driver (solid) and a dynamic driver (dashed) compared with the input impedance of an IEC711 Artificial Ear (dash-dot). The BA device is seen to have substantially higher source impedance than the dynamic driver. The BA driver has source impedance significantly above the reference load represented by the input impedance of the IEC711 Artificial Ear (taken as representative of the human ear) over the 20 Hz-20 kHz human hearing range, whereas the dynamic driver operates with source impedance similar to (and over a significant part of the 20 Hz-20 kHz range below) that of the IEC711 load. The BA driver is, therefore, substantially a velocity source (the acoustic equivalent of the familiar electrical constant current source), whereas the dynamic driver acts as a "mixed" source.

It has been noted that the BA driver is coupled to the ear via a waveguide. The combination of such a simple waveguide (length l, radius r) and the volume of air in the (sealed) outer ear (volume V) results in the simple, canonical "Helmholtz Resonator" acoustic network depicted as FIG. 2. The outer ear is sealed (or "occluded") by a "grommet" or "tip" component on an earphone. This seal is required in order that the acoustic load presented to the driver is maintained at an appropriately high magnitude. Any leaks in this seal will compromise the low frequency response of the system, given the relatively high acoustic source impedance of the BA driver introduced above.

Figure 2:
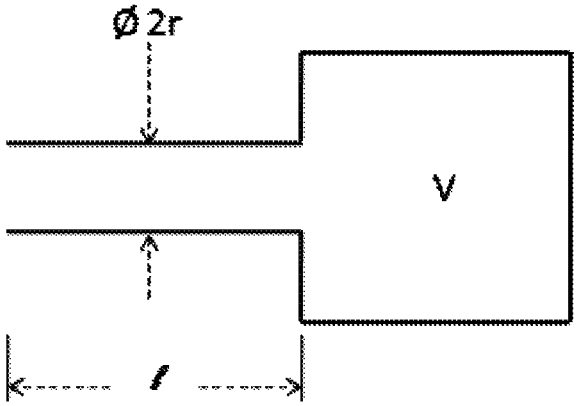
FIG. 2 shows a schematic illustration of a standard Helmholtz Resonator network.
Figure 3:
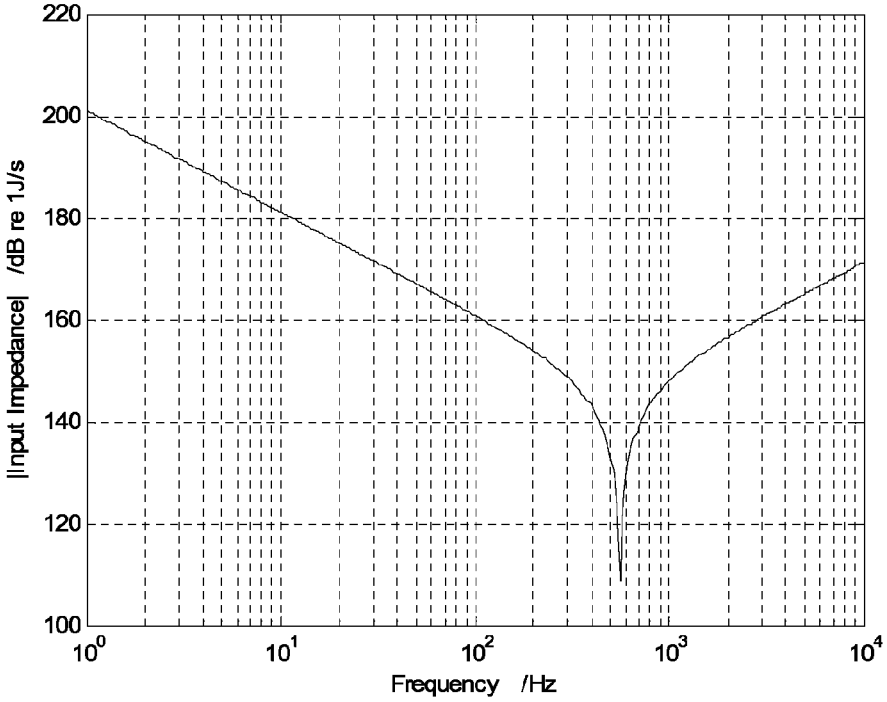
FIG. 3 is a graph illustrating the input impedance of the Helmholtz Resonator of FIG. 2.

The Helmholtz resonator of FIG. 2 has input impedance as depicted in FIG. 3 (in which resistive losses associated with friction and distributed parameter effects associated with wave motion are neglected). There is a conspicuous "dip" in the input impedance (at ~560 Hz, given the typical dimensions used: $r=0.001$ m, $l=0.015$ m, $V=2\times10^{-6}$ $m^3$). This "dip" in the input impedance of the system to which the BA driver is connected has special significance when it is desired to incorporate active control using "feedback" control architecture.

A feedback control system includes a microphone sensitive to the pressure in the sealed "outer ear" space. The output from this microphone is fed, via a filter, back to the driver (hence the name "feedback") and the filter is designed such that the action of the feedback loop is to reduce the pressure detected by the microphone. This reduction is simplified when the microphone is located close to the driver (as any distant location will introduce a pure time delay which cannot be "undone" by the filter action—equivalent to imposing a low-pass limit on the available controlling action).

Figure 4:
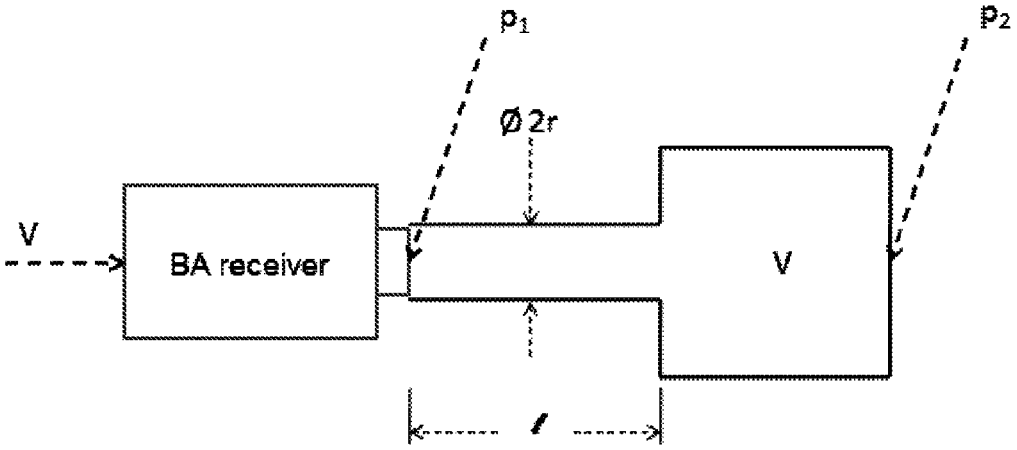
FIG. 4 is a schematic illustration of earphone apparatus comprising a BA driver.

The connection of a BA driver to the simplified waveguide/ear model Helmholtz Resonator of FIG. 2 is depicted as FIG. 4. The conventional proximate position for an active control sensing microphone would transduce the pressure $p_1$. In contrast, the wearer would hear the pressure developed at the eardrum, represented in this model by $p_2$.

Figure 5:
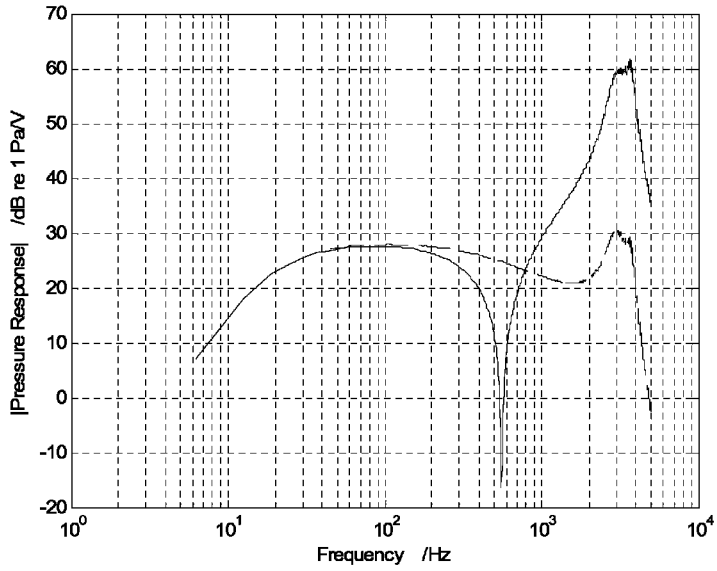
FIG. 5 is a graph illustrating pressure response at two locations in the earphone apparatus of FIG. 4.

FIG. 5 shows the modelled pressure responses $p_1/V$ and $p_2/V$ of a typical BA driver in the system of FIG. 4 with $p_1/V$ (solid) and $p_2/V$ (dashed). The response to the proximate sense microphone location, $p_1/V$, includes both the "dip" associated with the Helmholtz Resonance (c.f. FIG. 3) and a significant lift in the magnitude response above 1 kHz. In contrast, the pressure response to the ear, $p_2/V$, is much "flatter"; there is no evidence of the Helmholtz effect and the response above 1 kHz is smoother. Note that the pressure response of the sense microphone is practically flat, such that the electrical transfer function between driver input and microphone output tracks the magnitude response of (e.g.) FIG. 5.

Whilst the proximate location is known to be desirable in terms of minimising the time-of-flight delay between source and driver, it has been shown above to result in an undesirable transfer function. Two means to mitigate this undesirable response are taught in the present application—an acoustic approach and an electronic approach.

In the electronic approach, a filter with a peak response tuned exactly to compensate the dip in the $p_1/V$ characteristic (FIG. 5) in both magnitude and phase is utilised. The tuning of the peak in the filter must be precise and must take account of any changes associated with, e.g., differences in outer ear volume between two wearers.

The acoustic approach uses modifications to the acoustic system to achieve superior modification to the system response (that which will become the "plant response" in an automatic control application).

Figure 6:
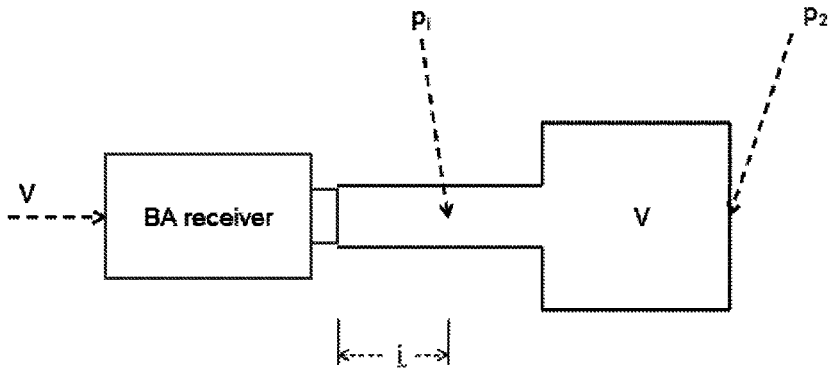
FIG. 6 is a schematic illustration of earphone apparatus in accordance with a first embodiment of the present invention.

If we move the microphone away from the driver to a less proximate position, the response should approach the limiting case $p_2/V$, representing the case when the sense microphone is in the "Ear" cavity (note that the cavity is modelled as a lumped element, such that pressure changes throughout this volume are—by definition—not represented). This concept of a BA driver with pressure observation at location along the length of the waveguide is depicted in FIG. 6, in which the pressure $p_i$ is sensed at position i, along the length of the waveguide.

Figure 7:
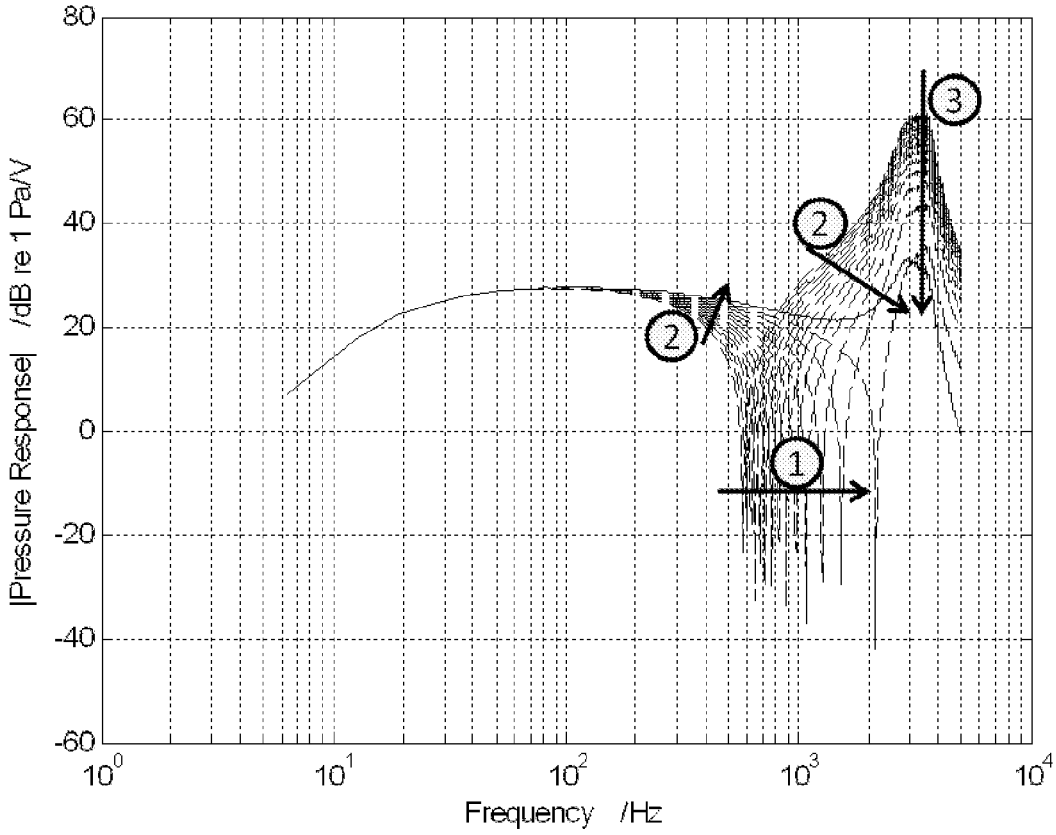
FIG. 7 is a graph illustrating pressure response at various locations in the earphone apparatus of FIG. 6 according to a first model.

The pressure response to a number of sense points (each 1 mm apart along the 15 mm length of the pipe) are shown in FIG. 7, with significant effects highlighted by the numbered arrows, as further explained below.

The Helmholtz Resonance is seen to increase in frequency as the sense point moves away from the driver, as suggested by arrow 1 in FIG. 7 in which pressure response pi/V at various locations along the waveguide (see FIG. 6) (dashed) and response with sense point in Volume (solid—c.f. FIG. 5) is shown. In fact the resonance is between the cavity and the portion of waveguide to the right of the sense point, where "rightward" is defined with reference to FIGS. 2, 4 & 6. As the sense point moves from the driver, the frequency response is "flattened" as suggested by arrows 2 and, particularly, the conspicuous peak at approximately 3 kHz is reduced in amplitude in the direction suggested by arrow 3. In practice, this predicted effect is not seen—it results from the naive simplicity of the model of the cavity representing the ear in the discussions to this point. If a more sophisticated model is used—for example a lumped parameter model of the IEC711 Artificial Ear—the more realistic predictions of FIG. 8 result.

Figure 8:
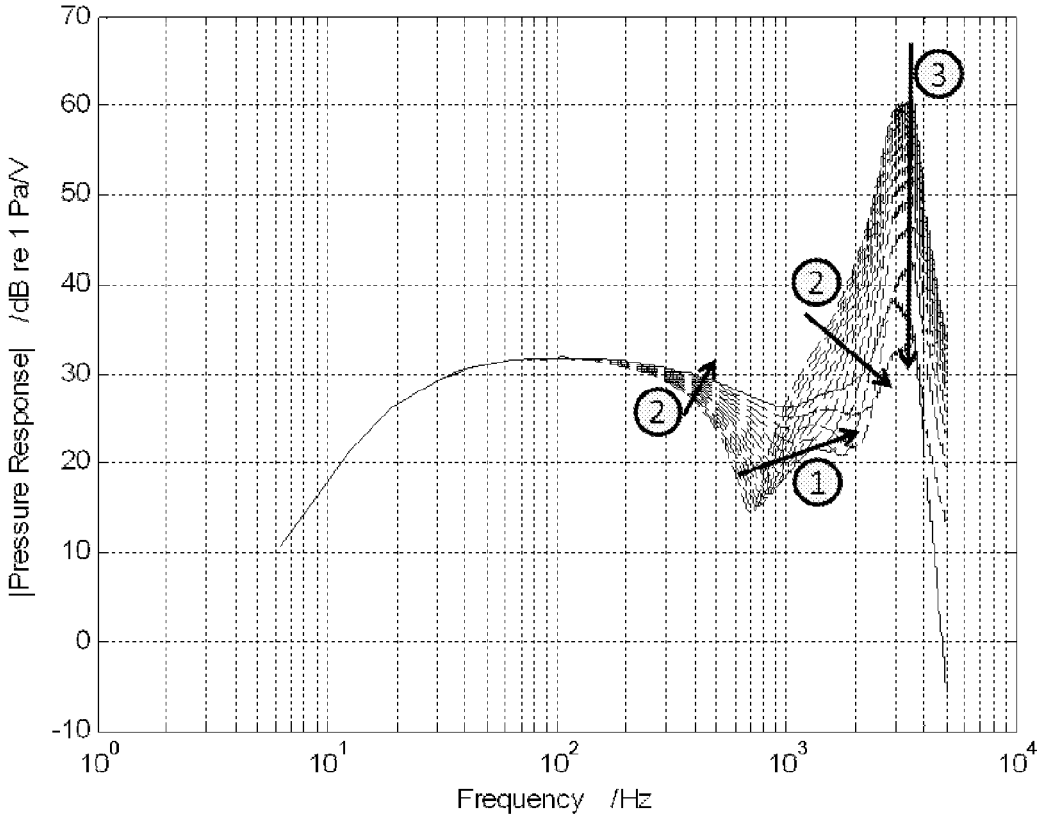
FIG. 8 is a graph illustrating pressure response at various locations in the earphone apparatus of FIG. 6 according to a second (more accurate) model.

FIG. 8 shows pressure response pi/V at various locations along the waveguide, but with Ear cavity represented by a two-port model of the IEC711 Artificial Ear (dashed) and response with sense point in (entrance to) the Artificial Ear (solid—c.f. FIG. 5). The dip associated with the Helmholtz resonance is clearly seen when the sense position is close to the driver, but is reduced in severity as the sense location moves towards the Ear end of the waveguide, as suggested by arrow 1. The Helmholtz Effect is minimised (it never perfectly disappears) when the microphone location is in the Ear Cavity. The response at higher frequencies (>1 kHz) is flattened as the sense location moves away from the driver, arrows 2 and 3 highlighting the change in pressure response with increasing separation, i (there is some apparent benefit to the higher frequency response in a location just within the waveguide).

Microphone Location in a Second Waveguide

Figure 9:
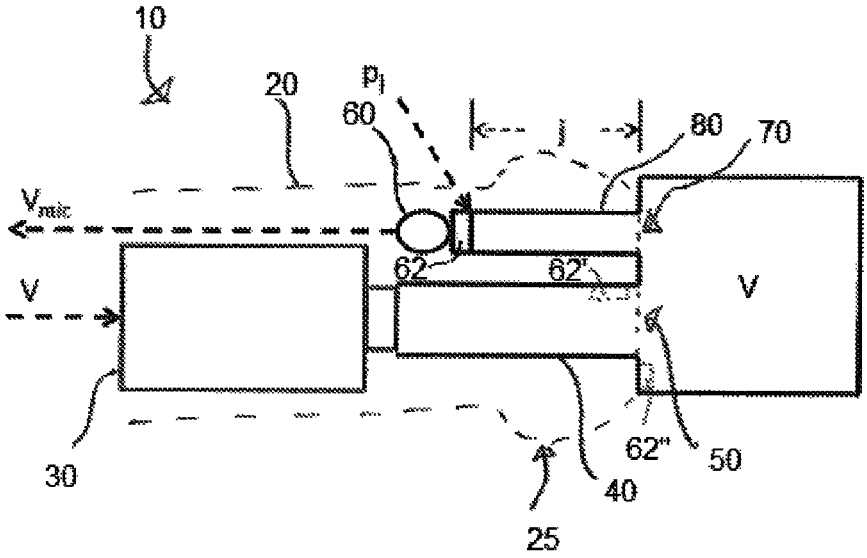
FIG. 9 is a schematic illustration of earphone apparatus in accordance with a further embodiment of the present invention.
Figure 10:
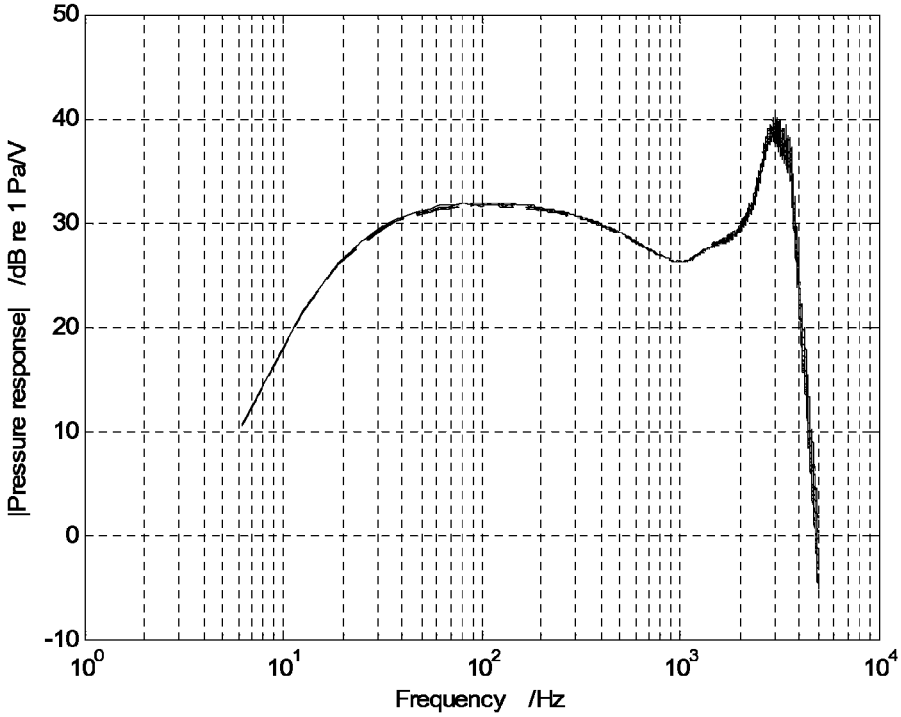
FIG. 10 is a graph illustrating pressure response in the earphone apparatus of FIG. 9 compared with pressure response in the ear cavity.

Having seen benefits to a less proximate location for the sense microphone, practical considerations may require that the microphone is moved even further from the driver. This can be achieved by coupling the microphone to the ear cavity via its own waveguide, as depicted in the earphone 10 of FIG. 9 comprising a body 20 configured to be inserted at least in part into an auditory canal V of a user's ear, body 20 housing a BA driver 30 and defining a first passageway 40 extending from BA driver 30 to an opening 50 in an outer surface of grommet 25 forming part of body 20 for allowing sound generated by BA driver 30 to pass into auditory canal V of the user's ear and a sensing microphone 60 coupled to body 20 for providing a feedback signal to a signal processor (not shown), sense microphone 60 comprising a sensing element 62 coupled to auditory canal V of the user's ear via a second passageway 80 extending to a further opening 70 in the outer surface of grommet 25 to sense sound present in auditory canal V of the user's ear (for reference alternative sensing element positions according to other embodiments of the present invention are represented by alternative sensing elements 62' and 62" positioned adjacent opening 50 and in advance of opening 50 respectively). BA driver 30 and sense microphone 60 are thus coupled to the ear via independent waveguides 40, 80. The microphone waveguide 80 has length indexed by "j". FIG. 10 shows the pressure response to microphone in a waveguide (dashed) $p_j/V$, where j represents the length of the microphone waveguide (in this case 1 to 15 mm in 1 mm steps). As reference, the response to the Ear cavity (solid) also is shown (c.f. FIG. 8).

FIG. 10 shows that the microphone waveguide 80 has negligible effect on the measured response, teaching that the second waveguide acts ONLY as a practical means to position the microphone—NOT as an acoustically active component. This is useful in cases where the tip end of the earphone is being designed to have minimum possible physical volume (to facilitate insertion into the ear canal) or when the physical size or aspect ratio of the microphone makes integration difficult. This is particularly important in the case of Micro-Machined Silicon ("MEMs") microphones which, although small, are usually of an awkward rectangular shape.

Controlling Higher Frequency Plant Response Effects

Up to this point, the simulated pressure responses have revealed the (potential for a) dip associated with a Helmholtz resonance in the 500-600 Hz region and a peak at ~3 kHz. These simulations have been produced using lumped parameter models of the outer ear represented as either the naive 2 cc volume or the slightly more sophisticated IEC711 Ear Simulator. In practice, the plant response at higher frequencies will have both high gain and significant resonant effects, which are inadequately modelled by the lumped parameter descriptors. This is illustrated by the measurement reported as FIG. 11 showing the measured plant response for a BA Driver and an ECM Microphone, each at the end of independent waveguides 12 mm in length.

Figure 11:
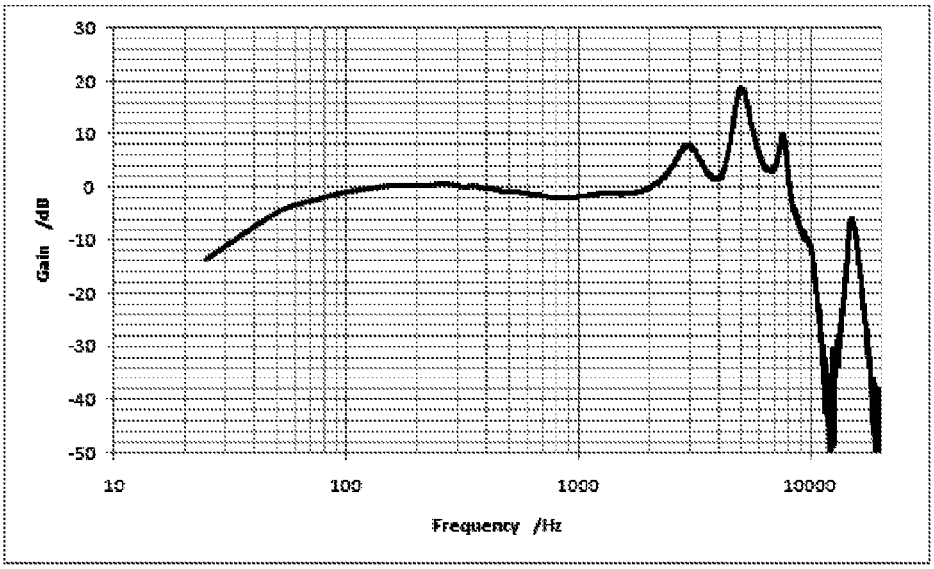
FIG. 11 is a graph illustrating the plant response for the earphone apparatus of FIG. 9.

As with the "Helmholtz" dip, the higher frequency peaks in the plant response seen in FIG. 11 can be addressed by two different means (or a combination of the two). The electronic approach, in which low-pass filter networks are introduced into the open loop will be considered later. First, we shall disclose acoustic means for managing the high gains seen in the plant response of which FIG. 11 is typical.

Acoustic Low-Pass Filtering

Figure 12:
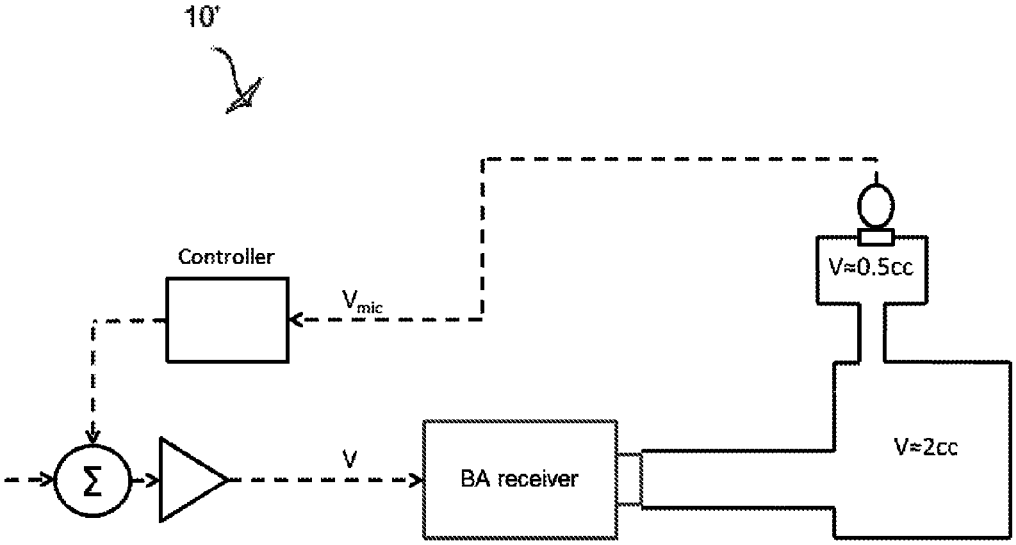
FIG. 12 is a schematic illustration of earphone apparatus in accordance with a further embodiment of the present invention.

FIG. 12 shows a modified version of earphone 10 (earphone 10') the sense microphone located in a cavity to give low-pass filtering action when coupled to a volume V. The earphone is equipped with a sense microphone, providing information for a feedback active control system. The sense microphone intentionally is located within a microphone cavity having physical dimensions configured to express compliant acoustic impedance. The action of this compliance in conjunction with the acoustic impedance of the small communicating passageway by which sound is conducted from the ear cavity to said microphone cavity provides the desired low-pass filtering.

The earphone is understood to be designed to have smallest feasible physical volume—not least as the comfortable, unobtrusive mounting on or partially in the wearer's ear is facilitated when the device is miniaturized. It is evident that the cavity in which the microphone is located must be contained within the earphone—so the cavity should have minimum possible volume. Conversely, tuning of the corner frequency of the low-pass filtering action to an appropriately low value is facilitated by maximising the cavity volume (the compliance being proportional to the volume). Accordingly, a balance must be struck between the conflicting desiderata of minimising the cavity volume to minimise overall earphone size and maximising the volume to maximise compliance.

In FIG. 12 and the descriptions which follow, a value of $0.5\times10^{-6}$ $m^3$ has been suggested. This is identified as the maximum feasible value (already it exceeds the physical volume of some earphone systems).

The communicating passageway between the cavity presented by the occluded outer ear and the sense microphone cavity will express acoustics which might be i) resistive, ii) inductive, iii) a combination of resistive and inductive or iv) a lossy waveguide element. These four models of behaviour (which arise in increasing order of complexity and of fidelity to the physical mechanisms in a practical embodiment) give rise to different types of low-pass filtering action.

Figure 13:
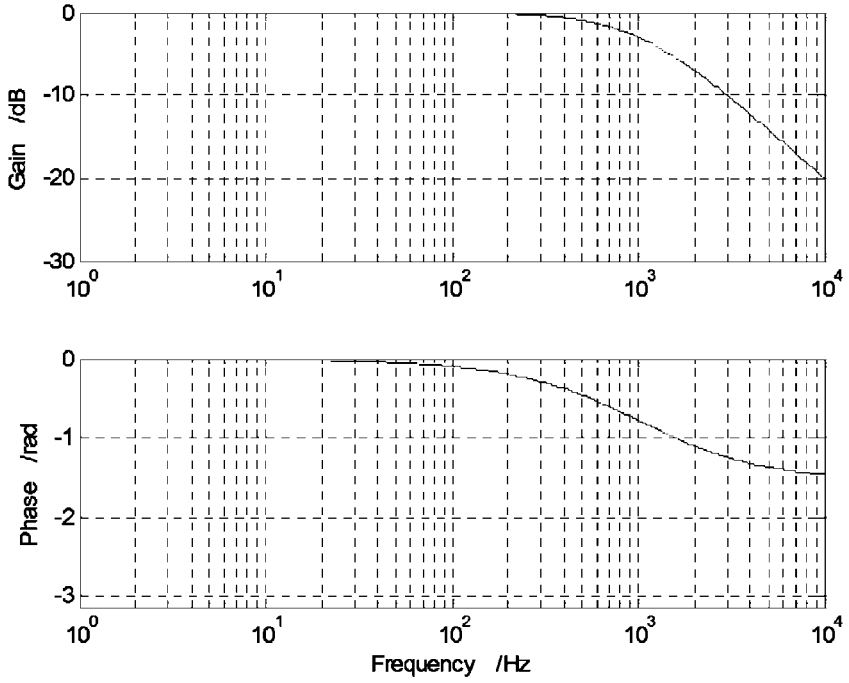
FIG. 13 is a series of graphs illustrating pressure gain across the acoustic low-pass filter of the earphone apparatus of FIG. 12 based on an acoustic low-pass filter providing resistive impedance.

If the communicating passageway is expected just to present a resistive acoustic impedance to sound propagating through it, the relationship between the sound pressure at the sense microphone and that in the outer ear cavity will be as described in FIG. 13, in which the system has been tuned to give a corner frequency of 1 kHz. This tuning is achieved by the selection of the 0.5 cc microphone cavity volume (however impractical this may be within an earphone system—see above) and selection of an appropriate acoustic resistor, of value $45.3\times10^6$ Rayls.

The pressure response reveals that the peak observed in the plant response (FIG. 11) at ~3 kHz might be subject to 10 dB attenuation after low-pass filtering through the characteristic defined by FIG. 13. Similarly, the peak at ~5 kHz might only be subject to 15 dB attenuation. In practice, filtering characteristics are selected to ensure that there is sufficient attenuation (e.g. at 5 kHz) to reduce the loop gain at this frequency in such a manner as to preserve useful active control in the desired Active Noise Reduction (ANR) bandwidth (which might extend up to 1 kHz).

The pressure response of the acoustic low-pass filter network of FIG. 12 when the communicating passageway expresses resistive impedance and the system is turned to a corner frequency of 1 kHz is shown as a Bode plot in FIG. 13 in order to reveal the phase as well as the magnitude response. Although the magnitude response is roughly constant in the ANR pass band, the phase response does show significant disturbance from 100 Hz upwards. This phase component will in practice need to be taken account of in the design of an appropriate controller.

The communicating passageway may intentionally be designed to express inductive impedance, by forming it as a pipe segment of designed length and cross-sectional area. Lumped-parameter inductive behaviour (and similar compliant behaviour for the cavity) will be encouraged if the diameter of the pipe is no greater than one fifth of the characteristic dimension of the microphone cavity (which should ideally be close-to-spherical—with a cubic form being an acceptable practical compromise). For the 0.5 cc maximum cavity volume introduced above, this places the pipe radius at maximum value of 0.79 mm. 1 kHz tuning would require the communicating passageway to be formed as a pipe with effective length of 11.8 mm, which is feasible given the presence of the ~15 mm waveguide already coupling the driver to the ear cavity. If a smaller microphone cavity is chosen, the pipe radius will reduce and the pipe length will increase to preserve tuning. In practice, this will impose a minimum size for the cavity/pipe combination.

In addition to the pure inductance described above a practical pipe will express resistance in consequence of viscous losses in the air flowing through it. Whilst some analytical treatments exist, experimental and empirical methods remain useful in micro-acoustics. These methods may be used to derive an overall resistance which gives critical damping or slightly under-damped response, as illustrated in FIG. 14.

Figure 14:
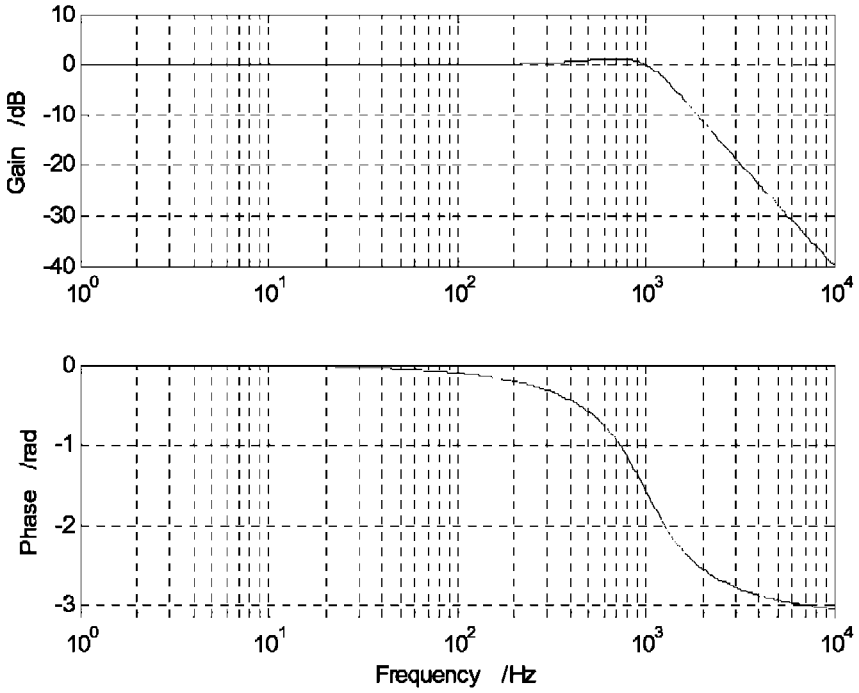
FIG. 14 is a series of graphs illustrating pressure gain across the acoustic low-pass filter of the earphone apparatus of FIG. 12 based on an acoustic low-pass filter providing inductive and resistive impedance.

FIG. 14 shows Bode plots of the pressure gain across the acoustic low-pass filter of FIG. 12 when the communicating passageway expresses inductive and resistive impedance and the system is tuned to corner frequency of 1 kHz with resistance equal to half the critical damping. In particular, FIG. 14 shows that the introduction of the inductive communicating passageway has given the second-order low-pass filtering characteristic above the corner frequency (−12 dB per octave). The figure reveals a slightly under-damped response (the resistance has been set to exactly one half that associated with critical damping) and—in this interesting case—the gain is unity at the corner frequency. The attenuation at 3 and 5 kHz is approximately 20 and 30 dB, respectively, which would be sufficient to control the plant response shown as FIG. 11. The phase response is no worse than the first-order solution (FIG. 13) below 500 Hz—but thereafter there are greater delays. This is due to the careful choice of damping—a critically-damped second-order system would have phase response poorer than the first-order system (FIG. 13) at all frequencies.

Electronic Low-Pass Filtering

The examples have served to emphasise how an acoustic network may be constructed to implement a low-pass function, reducing the high frequency loop gain observed with the BA driver (FIG. 11) to manageable levels for the implementation of feedback ANR. Similar filtering action can be achieved via electronic means, as suggested by FIG. 15 which shows a modified version of earphone 10 (earphone 10") the sense microphone for provision of feedback active control is optionally located in a waveguide (a) or in the ear cavity (b), with output subjected to electronic filtering.

Figure 15:
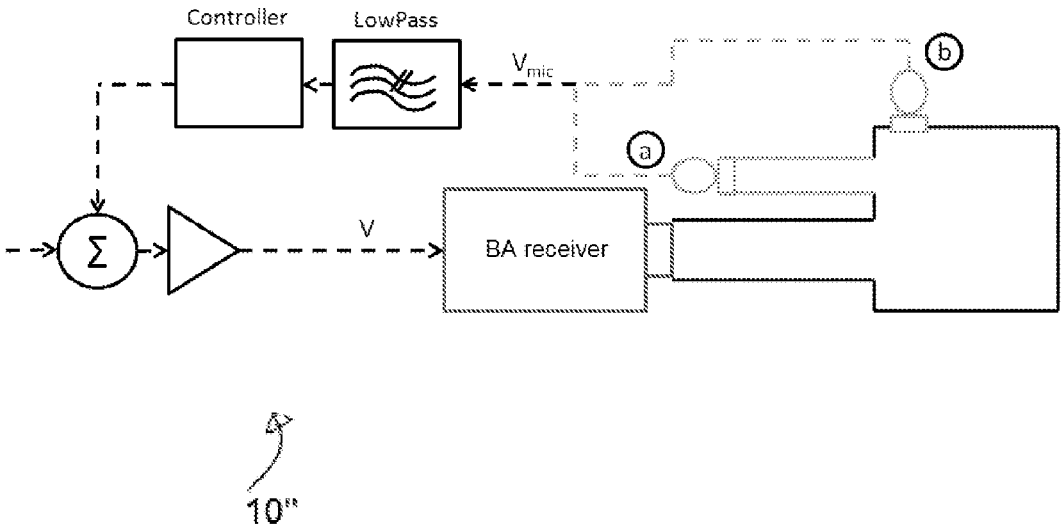
FIG. 15 is a schematic illustration of earphone apparatus according to a further embodiment of the present invention.

FIG. 15 shows a further modified version of earphone 10 (earphone 10''') comprising in which the sense microphone is placed to provide the sense input for a feedback active noise control scheme. The microphone is optionally located at the end of a waveguide or in the main ear cavity and its output is filtered by electronic means.

The electronic filter is capable of implementing any of the filters discussed under "acoustic" implementation—but with greater flexibility and control (such as great flexibility in adjusting the damping ratio and setting tuning). Furthermore, in addition to duplicating the acoustic methods discussed above, the electronic filter may advantageously be configured to implement higher-order, more complicated filters. Additionally, electronic embodiment of the low-pass filtering does not require small passageways in the earphone susceptible to partial blockage by contaminants, wax, etc.

Supplementing Low-Pass Filtering with Notch Filtering

It has been demonstrated how the phase response of practical low-pass filters may introduce undesirable disturbance within the bandwidth of intended active control. This can be minimised by supplementing the low-pass filter(s) (achieved in either acoustic and/or electronic means) with an electronic notch filter. Such a notch filter may be applied to one of the peaks in the plant response (such as the ~3 kHz effect in FIG. 11).

Figure 16:
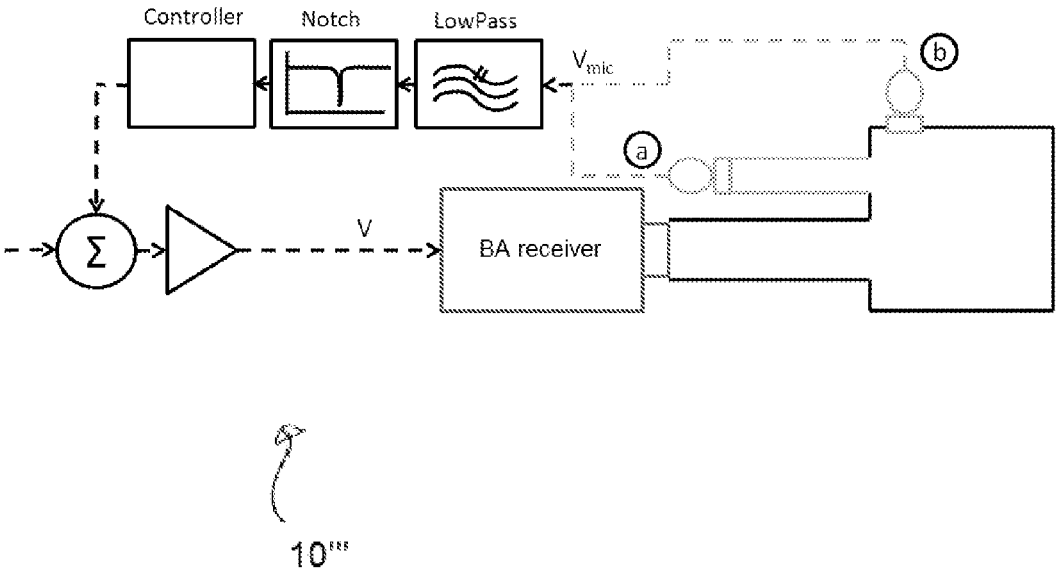
FIG. 16 is a schematic illustration of earphone apparatus according to a further embodiment of the present invention.

The scheme is illustrated in FIG. 16, which shows an earphone system, using a BA driver, in which a sense microphone configured to provide the sense input for a feedback active noise control scheme is optionally located in a waveguide (a) or in the ear cavity (b), with output subjected to electronic filtering, including a notch filter network. The microphone is optionally located at the end of a waveguide or in the main ear cavity and its output is filtered by electronic means, including a notch filter. The notch is tuned to attenuate one of the peaks in the plant response, allowing supplementary low-pass filtering to be tuned to a higher corner frequency. This minimises the phase/group delay effects in the ANR passband.

The invention claimed is:

1. Earphone apparatus comprising:

a body configured to be inserted at least in part into an auditory canal of a user's ear, the body housing a driver and defining a passageway connecting the driver to an opening in the body for allowing sound generated by the driver to pass into the auditory canal of the user's ear; and a sensing microphone coupled to the body for providing a feedback signal to a signal processor configured to generate a noise suppression signal capable of reducing occlusion effects from the sound heard by the user, the sensing microphone comprising a sensing element positioned to sense sound present in the auditory canal of the user's ear;

wherein the sensing element is spaced from the driver, and wherein the sensing element is positioned outside of the passageway in a location beyond the opening in the body with the sensing element being acoustically linked to the driver by an acoustic path extending through the full length of the passageway.

2. Earphone apparatus according to claim 1, wherein the driver is a Balanced Armature (BA) driver or other high source impedance driver.

3. Earphone apparatus according to claim 1, wherein the sensing element is positioned adjacent the opening in the body.

4. Apparatus according to claim 1, wherein the sensing element is located in a more advanced position than the opening when the body is inserted at least in part into the auditory canal of a user's ear.

5. Apparatus according to claim 1, further comprises an electronic low-pass filter.

6. Apparatus according to claim 5, further comprising a notch filter.

7. Apparatus according to claim 1, wherein the earphone apparatus forms part of a hearing-aid.

8. Apparatus according to claim 1, wherein the earphone apparatus forms part of a headset including a microphone for a user to speak into.

9. Earphone apparatus comprising:

a body configured to be inserted at least in part into an auditory canal of a user's ear, the body housing a driver and defining a passageway connecting the driver to an opening in the body for allowing sound generated by the driver to pass into the auditory canal of the user's ear; and a sensing microphone coupled to the body for providing a feedback signal to a signal processor configured to generate a noise suppression signal capable of reducing occlusion effects from the sound heard by the user, the sensing microphone comprising a sensing element positioned to sense sound present in the auditory canal of the user's ear;

wherein the sensing element is spaced from the driver, wherein the sensing element is positioned outside of the passageway, and wherein the sensing element is located in a more advanced position than the opening when the body is inserted at least in part into the auditory canal of the user's ear.

* * * * *